US006866896B2

(12) United States Patent
Heimann et al.

(10) Patent No.: US 6,866,896 B2
(45) Date of Patent: Mar. 15, 2005

(54) METHOD FOR TREATING METALLIC SURFACES AND PRODUCTS FORMED THEREBY

(75) Inventors: Robert L. Heimann, Centralia, MO (US); Bruce Flint, Columbia, MO (US); Ravi Chandran, New Brunswick, NJ (US); Jonathan L. Bass, Audubon, PA (US); James S. Falcone, Jr., West Chester, PA (US)

(73) Assignee: Elisha Holding LLC, Moberly, MO (US)

( * ) Notice: Subject to any disclaimer, the term of this patent is extended or adjusted under 35 U.S.C. 154(b) by 0 days.

(21) Appl. No.: 10/359,402

(22) Filed: Feb. 5, 2003

(65) Prior Publication Data

US 2003/0165627 A1 Sep. 4, 2003

Related U.S. Application Data

(60) Provisional application No. 60/354,565, filed on Feb. 5, 2002.

(51) Int. Cl.[7] ..... B05D 1/00; C23C 28/00

(52) U.S. Cl. ..... 427/397.8; 427/419.2; 205/198; 205/205

(58) Field of Search ..... 427/376.1, 376.2, 427/397.8, 402, 419.1, 419.2, 327, 407.1; 205/106, 198, 205

(56) References Cited

U.S. PATENT DOCUMENTS

| | | | |
|---|---|---|---|
| 1,129,329 | A | 2/1915 | Vail et al. |
| 1,289,215 | A | 12/1918 | MacGahan |
| 1,366,305 | A | 1/1921 | Whyte |
| 1,540,766 | A | 6/1925 | Daniels et al. |
| 1,744,116 | A | 1/1930 | Hannen et al. |
| 1,844,670 | A | 2/1932 | Manson |
| 1,909,365 | A | 5/1933 | Knaber |
| 1,912,175 | A | 5/1933 | Blough et al. |
| 1,946,146 | A | 2/1934 | Kieler et al. |
| 2,462,763 | A | 2/1949 | Nightinghall |
| 2,475,330 | A | 7/1949 | Nightinghall |
| 2,495,457 | A | 1/1950 | Jacobs |
| 2,512,563 | A | 6/1950 | De Long |
| 2,539,455 | A | 1/1951 | Mazia |
| 2,641,556 | A | 6/1953 | Robinson |
| 2,780,591 | A | 2/1957 | Frey |
| 2,855,328 | A | 10/1958 | Long |
| 3,224,927 | A | 12/1965 | Brown et al. |
| 3,301,701 | A | 1/1967 | Baker et al. |
| 3,444,007 | A | 5/1969 | Mauer et al. |
| 3,515,600 | A | 6/1970 | Jones et al. |
| 3,658,662 | A | 4/1972 | Casson, Jr. et al. |
| 3,663,277 | A | 5/1972 | Koepp et al. |
| 3,687,740 | A | 8/1972 | Pearlstein et al. |
| 3,796,608 | A | 3/1974 | Pearlman |
| 3,839,256 | A | 10/1974 | Parkinson |
| 3,920,468 | A | 11/1975 | Brown et al. |
| 3,993,548 | A | 11/1976 | Creutz et al. |

(List continued on next page.)

FOREIGN PATENT DOCUMENTS

| | | |
|---|---|---|
| DE | 26 40 419 | 3/1977 |
| EP | 0 045 017 | 7/1981 |

(List continued on next page.)

OTHER PUBLICATIONS

S/N 09/775,072.

S/N 09/816,879.

S/N 09//55,072.

S/N 09/814,611.

S/N 10/211,029.

S/N 10/211,051.

S/N 10/211,094.

Electrodeposition & Characterization of a Corrusion Resistant Zine–Nickel–Phosphorus Alloy, By A. Krishniyer, M. Ramasubramanian, B. N. Popov & R.A. White Jan. 1999.

Ellipsometric and Ram, a Spectrscopic Study of Thermally Formed Films on Titanium, P. Hristova and Li Asov. B.N. Popov and R.B. White J. Electrochem Soc., vol. 145, No. 7, Jul. 1997/The Electrochemical Society, Inc.

Galvanostatic Tube and Pulse Reverse Plating of Zinc–Nickel Alloys from Sulfate Electrolytes on a RotatingDisc Electrode—B.N. Popov, M. Ramasubramanian, S.N. Popova, R.B. White and K–M Yio J. Chem. Soc., Faraday Trans. vol. 92 (4021–4027), 1996. No month avail.

Galavanostatic Pulse and Pulse Reverse Plating of Nickel–Iron Alloys from Electrolytes Containing Organic Compounds on a Rotating Disk Electrod—B.N. Popov, Kea–Ming Yin, and E. White, J Electrochem. Soc. 140(5), May 1993.

Silicate Species in High pH Solution Molybdate, Whose Silica Concentration is Determined by Coloimetry—Miho Tanaka, Kazuya Takahashib—The Tokyo Univ. ov Fisheries, Konan, Minato–ku, Tokyo 1088477, Japan, The Institute of Physical and Chemical Research (RIKLN), Hirosawa, Vako, Suitama 3510198, Japan, Oct. 2, 2000, Oct. 30, 2000, Analytica Chimica Acta pp. 117–123.

(List continued on next page.)

*Primary Examiner*—Shrive P. Beck
*Assistant Examiner*—William Phillip Fletcher, III
(74) *Attorney, Agent, or Firm*—Michael K. Boyer

(57) ABSTRACT

An electroless or electrolytic process for treating metallic surfaces is disclosed. The disclosed process exposes the metallic surface to a first medium comprising at least one silicate, and then to a second medium comprising colloidal silica (additional processing steps can be employed before, between and after exposure to the first and second mediums). The first and second mediums can be electrolytic or electroless.

31 Claims, 2 Drawing Sheets

U.S. PATENT DOCUMENTS 4,059,658 A 11/1977 Shoup et al.
4,082,626 A 4/1978 Hradcovsky
4,101,692 A 7/1978 Lomasney et al.
4,105,511 A 8/1978 Nikaido et al.
4,150,191 A 4/1979 Karki
4,166,777 A 9/1979 Casson, Jr. et al.
4,169,916 A 10/1979 Tsutsui et al.
4,184,926 A 1/1980 Kozak
4,193,851 A 3/1980 Crawford et al.
4,222,779 A 9/1980 Bengali et al.
4,240,838 A 12/1980 Blasko et al.
4,288,252 A 9/1981 Neely
4,351,883 A 9/1982 Marcantonio et al.
4,367,099 A 1/1983 Lash et al.
4,412,863 A 11/1983 Neely, Jr.
4,425,166 A 1/1984 Pavlik et al.
4,427,499 A 1/1984 Hitomi et al.
4,460,630 A * 7/1984 Nishino et al.
4,478,905 A 10/1984 Neely, Jr.
4,599,371 A 7/1986 Loch et al.
4,620,904 A 11/1986 Kozak
4,645,790 A 2/1987 Frey et al.
4,705,576 A 11/1987 Klos et al.
4,756,805 A 7/1988 Terada et al.
4,786,336 A 11/1988 Schoener et al.
4,921,552 A 5/1990 Sander et al.
4,992,116 A 2/1991 Hallman
5,068,134 A 11/1991 Cole et al.
5,091,224 A * 2/1992 Kushida et al.
5,108,793 A 4/1992 van Oij et al.
5,202,422 A * 4/1993 Hiatt et al. ..... 424/132.1
5,221,371 A 6/1993 Miller
5,223,106 A 6/1993 Gerace et al.
5,275,703 A 1/1994 Shih et al.
5,275,713 A 1/1994 Hradcovsky
5,283,131 A 2/1994 Mori et al.
5,338,434 A 8/1994 Ruhl et al.
5,342,456 A 8/1994 Dolan
5,346,598 A 9/1994 Riffe et al.
5,352,342 A 10/1994 Riffe
5,368,655 A 11/1994 Klos
5,380,374 A 1/1995 Tomlinson
5,433,976 A 7/1995 van Ooij et al.
5,478,451 A 12/1995 Riffe
5,478,655 A 12/1995 Sabata et al.
5,489,373 A 2/1996 Parthasarathi
5,498,284 A 3/1996 Neely, Jr.
5,585,109 A * 12/1996 Hayward et al. ..... 424/450
5,603,818 A 2/1997 Brent et al.
5,616,229 A 4/1997 Samsonov et al.
5,653,823 A 8/1997 McMillen et al.
5,658,697 A 8/1997 Lin
5,660,707 A 8/1997 Shastry et al.
5,660,709 A 8/1997 Bauer et al.
5,672,390 A 9/1997 Crews, IV et al.
5,674,371 A 10/1997 Patel
5,674,790 A 10/1997 Araujo
5,681,378 A 10/1997 Kerheve
5,681,658 A 10/1997 Anderson et al.
5,683,522 A 11/1997 Joesten
5,683,567 A 11/1997 Shimamune et al.
5,683,568 A 11/1997 Harris et al.
5,683,751 A 11/1997 Derule et al.
5,743,953 A 4/1998 Twardowska et al.
5,750,085 A 5/1998 Yamada et al.
5,750,188 A 5/1998 Menu
5,766,564 A 6/1998 Tijburg et al.
5,807,428 A 9/1998 Bose et al.
5,824,366 A 10/1998 Bose et al.
5,868,819 A 2/1999 Guhde et al.
5,871,668 A * 2/1999 Heimann et al. ..... 252/389.62
5,876,517 A 3/1999 Jeannier
5,900,136 A 5/1999 Gotsu et al.
5,906,971 A 5/1999 Lark
5,916,516 A 6/1999 Kolb
6,083,362 A 7/2000 Hryn et al.
6,083,374 A 7/2000 Kopp
6,149,794 A 11/2000 Heimann et al. ..... 205/316
6,153,080 A 11/2000 Heimann et al. ..... 205/199
6,258,243 B1 7/2001 Heimann et al. ..... 205/316
6,322,687 B1 11/2001 Heimann et al. ..... 205/316
6,455,100 B1 * 9/2002 Heimann et al.
2003/0118861 A1 * 6/2003 Heimann et al.

FOREIGN PATENT DOCUMENTS

EP 0 087 288 2/1983
EP 0 492 306 A2 12/1991
EP 0 716 163 B1 11/1995
EP 0 716 163 A1 11/1995
EP 0 808 883 A2 5/1997
EP 0985743 A1 3/2000
GB 498485 2/1939
JP 53060937 5/1978
JP 55091997 11/1980
JP 61057654 3/1986
JP 6016460 8/1987
JP 1149980 6/1989
JP 1240674 9/1989
JP 2125884 5/1990
JP 3221275 9/1991
JP 3260095 11/1991
JP 5-195252 1/1992
JP 5-255889 3/1992
JP 5-287585 4/1992
JP 4301096 10/1992
JP 5070974 3/1993
JP 5125553 5/1993
JP 5140761 6/1993
JP 5195252 8/1993
JP 5255889 10/1993
JP 5279869 10/1993
JP 5287585 11/1993
JP 7-179949 12/1993
JP 7179949 7/1995
JP 10310722 11/1998
JP 11209891 8/1999
RU 2063486 10/1996
WO WO 94/18362 8/1994
WO WO 97/03231 1/1997
WO WO 97/40208 10/1997
WO WO 98/33856 8/1998
WO WO 98/33960 8/1998
WO WO 99/31303 6/1999
WO WO 01/12883 2/2001
WO WO 01/71067 9/2001

OTHER PUBLICATIONS

Silicon–29 NMR Studies of Aqueous Silicate Solutions. 2. Transverse 29 Si Relaxa and the Kinetics and Mechanism of Silicate Polymerization, Stephen D. Kin de and Thomas W. Swaddle, Nov. 25, 1987, Inorg. Chem. 1988, 27,4259–4204, pp. 4259–4264.

Soaking Up Rays—A primitive marine creature has natural–glass fibers that hint at high tech—Peter Weiss (Silica Skeletons)—Aug. 4, 2001, Science News, vol. 16, pp. 77–79.

A cathodically deposited mineral coating for replacement of Cr(VI) and Cr(III) treatments of Zinc—Nancy Helmann, at AESR/EPA Conference, Feb. 1, 2001.

Development and commercialization of non–chrome electrolytic surface treatment for metallic surfaces—Wayne L. Soucie, Nancy G. Heimann, Robert L. Heinmann Information Exchange Seven Spa Resort, Champion, PA, Sep. 26, 2000.
Modification and characterization of Mineralization Surface for Corrosion Protection—John J. Hahn Nancy G. McGowan and Robert L. Heimann, T ery L Barr, No date.
Zero chance electrolytic surface treatment for metallic surfaces—Part I—Bob Heimann, Bill Dalton & Wayne Souele, Dr. Ravi Chandran. No date.
B. Cabot, A. Foissy—Reversal of the surface charge of a mineral powder, application to electrophoretic deposition of silica for anticorrosion coatings—Journal of Materials Science 33 (1998) 3045–3952 No month.
A. E. Climel—Effect of Zn2+—on the Correlation Radius in the Na20–Zn0–Si02 System Inorganic Materials vol. 32, Nov. 3, 1996, pp. 321–322 No month.
Ing. J. Kohnen—Long Life Corrosion Protection with Unorganic Zinc Silicates Verfahrenstechnik (Mainz), 1968; 2(5):217–20 No Month.
Hografe, Andre Rene; Czank, Michael—Michael—Synthetic dipotassium zinc disilicate—Mineralogisches Inst., Univ. Kiel, Kiel, Germany, Acta Crystallogr., Sect, C: Cryst. Struct. Commun (1995), C5J(9), 1728–30. CODEN. ACSCEE ISSN: 0108–2701 Journal written in English. CAN 123:271293 AN 1995:840577 CAPLUS No month.
Kharitonov, Yu, Ya; Khomuotv, N.E. and Akol'zin, A.P. (Mosk. Khim–Tekhnol. Inst., Moscow, USSR—Study of the reaction of iron hydroxides and oxides with sodium silicate and silicate acid solutions. Zushet. Met. 1978, 14(1):89–90, CODEN:ZAMEA9;ISSN :0044–1856 No month.
Pretreatment and Surface Preparation, Ande, K. Matsushima, Y. Journal Name: Bosie Kanri (Rust Prev. Control) 31. (7)—Jul. 1987, pp. 214–221, ISSN—0520–6340. Language Japanese and English translation.
Anomalous Codeposition of Fe–Ni Alloys and Fe–N1–Si02 Compositos under Pot entiostatic Conditions—Experimental Study and Mathematical Model—M. Ramasubramanian, S.N. Popov, and R.E. White—J. Elect rochem Soc., vol. 143, No. 2, Jul. 1996. The Elect rochemical Society, Inc.
ASM Handbook, 1994, pp. 4, 7, 8 and 10. No month avail.
brown et al.—Silicates as Cleaners in the Production of Tin Plate II, Influence of Bat ch Anneal, Plating Oct. 1971.
Characterization of Hydrogen Permeation through Zinc–Nickel Alloys under Corroding Conditions: Mathematical Model and Experimental Study—M. Ramansubra—manian. B.N. Popov, and R.K. White—J. Electrochem. Soc., vol. 145, No. 6, Jun. 1998.
Characterization of Hydrogen Permeation Through a Corrosion–Resistant Zinc–Nickel–Phosphorous Alloy, A. Durairajan, A. Krishniyer, B.S. Haran, R.E. White, and B.N. Popov–Corrosion–vol. 56, No. 3, Mar. 2000.
Development of a New Electrodeposition Process for Plating of Zn–Ni–X (X=Cd,P) Alloys—I. Corrosion Characteristics of Zn–Ni–Cd Ternary Alloys—Anand Duradirajar Bala S. Haran, Ralph E. White and Branko N. Popov—Journal of the Electrochemical Society, 147 (5) S–2 Proof pp. (2000). No month avail.
Development of a New Electrodeposition Process for Plating of Zn–Ni–X (X=Cd, P), Alloys, Permeation Characteristics of Zn–N1–Cd Ternary Alloys—A. Durairajan, B.S. Haran, R.E. White, B.N. Popov—Hournal of the Electrochemical Society, 147 (2) S–2 (2000) No month avail.
ISFEC 92 Conference, Sep. 1992 Watson, et al.—The Electro–deposition of Zinc Chromium Alloys and the Formation of Conversion Coatings Without Use of Chromata Solutions.
Mass Transport effects on the electrodeposition of iron nickel alloys at the presence of additives—K.M. Yin, J.H. Wei, J.R. Yu, R.N. Popov, S.N. Popova, R.E. White Journal of Applied Electrochemistry 25(1995) 543–555. No month avail.

The Chemistry of Silica—Solubility, Polymerization, Colloid and Surface Properties, and Biochemistry—Ralph K. Iller– John Wiley & Sons—Copyright 1979, pp. 83–85, 161–163. No month avail.

Soluble Silicates Their Properties and Uses—vol. 2: Technology James C. Vail, D Sc–Copyright 1952 1952, pp. 152, 231, and 284. No month avail.

Use of Underpotential Deposition of Zinc to Mitigate Hydrogen Absorption into Monel K500—G. Zheng, B.N. Popov, and R.E. White, Journal Electrochem. Soc. 141(5), May 1994.

The Depolymerization of Silica in Sodium Hydroxide Solutions S.A. Greenberg Laboratory for Physical and Inorganic Chemistry, Leiden, Holland Mar. 11, 1957 vol. 61 pp. 960–965.

Effect of pH on Polymerization of Silicic Acid—Katsumi Goto, Faculty of Engineering, Hokkaido University, Sappor. Japan—Mar. 13, 1956 Jul. 1956, pp. 1007–1008.

Effects of Amide Additive on Polymerization of Silica Under Acidic Conditions—Tatsuro Horiuchi, Government Industiral Research Institute, Nagoya, 1–1, Hirat e–cho, Kita–ku. Nagoya 462 Japan—May 11, 1991, revised received Feb. 5, 1992—Journal of Non–Crystalline Solids.

Kinetics of Silica Polymerization and Deposition from Dilute Solutions between 5 and 180 degree C—H.P. Rothbaum and A.G. Rohde, Chemistry Division, Dept. of Scientific and Industrial Research, Lower Hutt, New Zealand, Dec. 13, 1978, accepted Jan. 25, 1979—Journal of Colloid and Int erface Science, vol. 71, No. 3, Oct. 1, 1979, pp. 533–559.

The Polymerization of Monosilicic Acid—G.B. Alexander—Oct. 7, 1953 Grasselli Chemicals Dept., Experimental Station, E.I. DuPont de Nemours & Co., Inc. pp. 2004–2096, vol. 76.

The Polymerization of Silicic Acid—Sidney A. Greenberg and David Sinclair, Johns–Manville Research Center, Manville, N.J. Nov. 20, 1954, May 1955, pp. 435–440.

Polymerization of Polysysilicic Acid Derived from 3.3 Ratio Sodium Silicate R.K. Iler–Grasselli Chemicals Dept., Experimental Station, E.I. DuPont de Nemours and Company, Inc. Jan. 22, 1953, vol. 57, pp. 604–607.

The Preparation of Monosilicic Acid—G.B. Alexander—Jan. 16, 1953, Jun. 20, 1953, pp. 2887–2888.

The Rection of Low Molecular Weight Silicic Acids with Molybdic Acid, G.B. Alexander, Jun. 11, 1953, pp. 5655–5657.

* cited by examiner

METHOD FOR TREATING METALLIC SURFACES AND PRODUCTS FORMED THEREBY

The subject matter herein claims benefit under 35 U.S.C. 119(e) of U.S. patent application Ser. No. 60/354,565, filed Feb. 05, 2002 and entitled "Method For Treating Metallic Surfaces"; the disclosure of which is hereby incorporated by reference.

FIELD OF THE INVENTION

The field of the invention relates to using silicate and colloidal silica containing mediums for treating metallic surfaces.

BACKGROUND OF THE INVENTION

Silicates have been used in electrocleaning operations to clean steel, tin, among other surfaces. Electrocleaning is typically employed as a cleaning step prior to an electroplating operation. Usage of silicates as cleaners is described in "Silicates As Cleaners In The Production of Tinplate" is described by L. J. Brown in February 1966 edition of *Plating*; European Patent No. 00536832/EP B1 (Metallgesellschaft AG); U.S. Pat. Nos. 5,902,415, 5,352,296 and 4,492,616. Processes for electrolytically forming a protective layer or film by using an anodic method are disclosed by U.S. Pat. No. 3,658,662 (Casson, Jr. et al.), and United Kingdom Patent No. 498,485.

U.S. Pat. No. 5,352,342 to Riffe, which issued on Oct. 4, 1994 and is entitled "Method And Apparatus For Preventing Corrosion Of Metal Structures" that describes using electromotive forces upon a zinc solvent containing paint; hereby incorporated by reference. U.S. Pat. Nos. 5,700,523, and 5,451,431; and German Patent No. 93115628 describes a processes for using alkaline metasilicates to treat metallic surfaces.

There is a need in this art for an environmentally benign metal treatment (i.e., substantially chromate free) that imparts corrosion resistance to metallic surfaces. The disclosure of the previously identified patents and publications is hereby incorporated by reference.

SUMMARY OF THE INVENTION

The instant invention solves problems associated with conventional practices by providing an electroless or electrolytic process for treating metallic surfaces. The process exposes the metallic surface to a first medium comprising at least one silicate, and then to a second medium comprising colloidal silica (additional processing steps can be employed before, between and after exposure to the first and second mediums). The first and second mediums can be electrolytic or electroless. Normally, the first medium comprises an electrolytic environment whereas the second medium comprises an electroless environment.

By "electroless" it is meant that no current is applied from an external source (a current may be generated in-situ due to an interaction between the metallic surface and at least one medium). By "electrolytic" or "electrodeposition" or "electrically enhanced", it is meant to refer to an environment created by introducing or passing an electrical current through a silicate containing medium while in contact with an electrically conductive substrate (or having an electrically conductive surface) and wherein the substrate functions as the cathode. By "metal containing", "metal", or "metallic", it is meant to refer to sheets, shaped articles, fibers, rods, particles, continuous lengths such as coil and wire, metallized surfaces, among other configurations that are based upon at least one metal and alloys including a metal having a naturally occurring, or chemically, mechanically or thermally modified surface. Typically a naturally occurring surface upon a metal will comprise a thin film or layer comprising at least one oxide, hydroxides, carbonates, sulfates, chlorides, among others. The naturally occurring surface can be removed or modified by using the inventive process. The metal containing surface refers to a metal article or body as well as a non-metallic member having an adhered metal or conductive layer. While any suitable surface can be treated by the inventive process, examples of suitable metal surfaces comprise at least one member selected from the group consisting of galvanized surfaces, sheradized surfaces (e.g, mechanically plated), zinc, iron, steel, brass, copper, nickel, tin, aluminum, lead, cadmium, magnesium, silver, barium, beryllium, calcium, strontium, cadmium, titanium, zirconium, manganese, cobalt, alloys thereof such as zinc-nickel alloys, tin-zinc alloys, zinc-cobalt alloys, zinc-iron alloys, among others. If desired, the inventive process can be employed to treat a non-conductive substrate having at least one surface coated with a metal, e.g., a metallized polymeric article or sheet, ceramic materials coated or encapsulated within a metal, among others. Examples of metallized polymer comprise at least one member selected from the group of polycarbonate, acrylonitrile butadiene styrene (ABS), rubber, silicone, phenolic, nylon, PVC, polyimide, melamine, polyethylene, polyproplyene, acrylic, fluorocarbon, polysulfone, polyphenyene, polyacetate, polystyrene, epoxy, among others. Conductive surfaces can also include carbon or graphite as well as conductive polymers (polyaniline for example).

The first medium of the inventive process can form silicate containing film or layer. The silicate containing film or layer can comprise a region comprising a monosilicate (e.g., zinc monosilicate) with a disilicate film upon the monosilicate region. The second medium of the inventive process can form a silica containing film or layer. The silica containing film or layer can comprise a region comprising monomeric silica or silica oligomers with a colloidal silica film upon the monomeric silica region.

A metallic surface that is treated by the inventive process can possess improved corrosion resistance, increased electrical resistance, heat resistance (including to molten metals), flexibility, resistance to stress crack corrosion, adhesion to sealer, paints and topcoats, among other properties. The improved heat resistance broadens the range of processes that can be performed subsequent to forming the inventive layer, e.g., heat cured topcoatings, stamping/shaping, riveting, among other processes. The corrosion resistance can be improved by adding a dopant to the silicate medium, using a rinse and/or applying at least one sealer/topcoating.

The inventive process is a marked improvement over conventional methods by obviating the need for solvents or solvent containing systems to form a corrosion resistant layer, e.g., a mineral layer. In contrast, to conventional methods the inventive process can be substantially solvent free. By "substantially solvent free" it is meant that less than about 5 wt. %, and normally less than about 1 wt. % volatile organic compounds (V.O.C.s) are present in the electrolytic environment.

The inventive process is also a marked improvement over conventional methods by reducing, if not eliminating, chromate and/or phosphate containing compounds (and issues attendant with using these compounds such as waste disposal, worker exposure, among other undesirable environmental impacts). While the inventive process can be employed to enhance chromated or phosphated surfaces, the inventive process can replace these surfaces with a more environmentally desirable surface. The inventive process, therefore, can be "substantially chromate free" and "substantially phosphate free" and in turn produce articles that are also substantially chromate (hexavalent and trivalent) free and substantially phosphate free. The inventive process can also be substantially free of heavy metals such as chromium, lead, cadmium, barium, among others. By substantially chromate free, substantially phosphate free and substantially heavy metal free it is meant that less than 5 wt. % and normally about 0 wt. % chromates, phosphates and/or heavy metals are present in a process for producing an article or the resultant article.

CROSS-REFERENCE TO RELATED PATENTS AND PATENT APPLICATIONS

Figure 1:
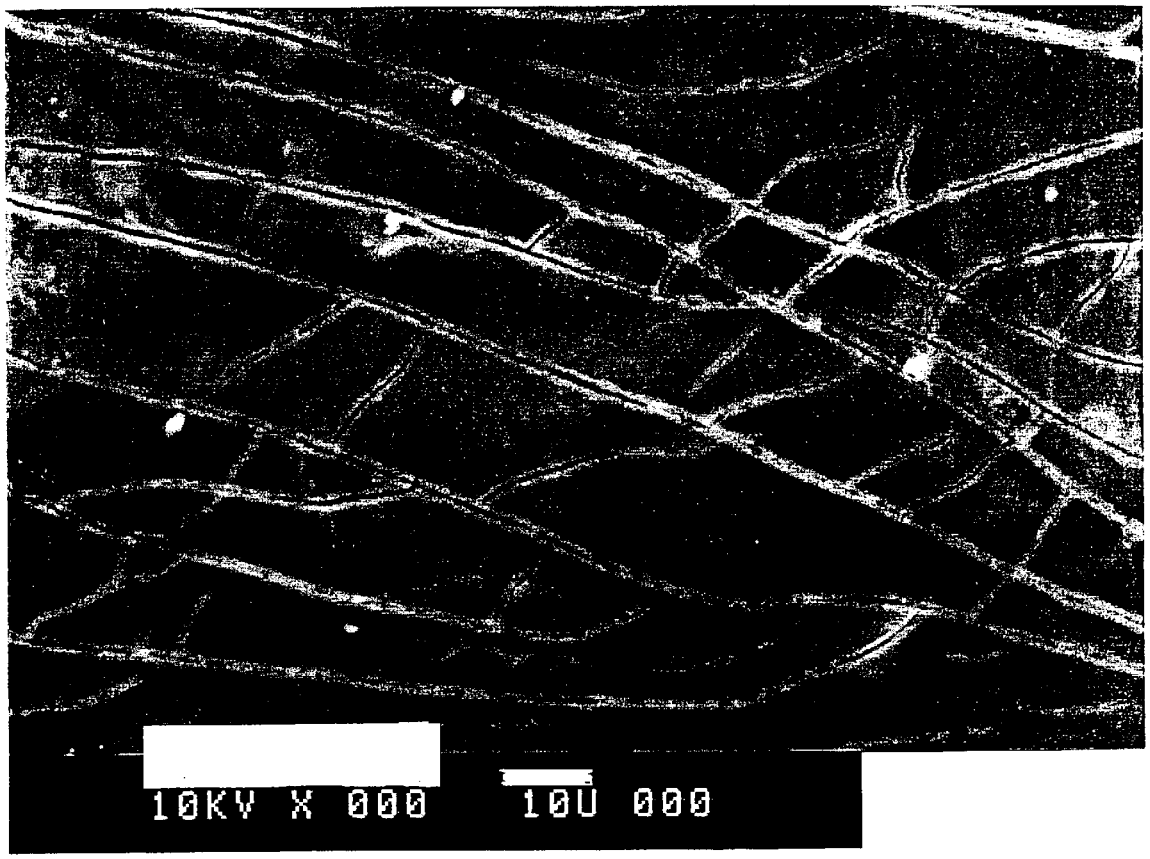
FIG. 1 is an SEM photomicrograph of a surface treated in accordance with Example.

The subject matter disclosed herein is related to U.S. patent application Ser. No. 09/814,641, filed on Mar. 22, 2001, and entitled "An Energy Enhanced Process For Treating A Conductive Surface And Products Formed Thereby"; Ser. No. 10/211,051, filed on Aug. 02, 2002, and entitled "An Electroless Process For Treating Metallic Surfaces And Products Formed Thereby"; Ser. No. 10/211,094, filed on Aug. 02, 2002 and entitled "An Energy Enhanced Process For Treating A Conductive Surface And Products Formed Thereby" and Ser. No. 10/211,029, filed on Aug. 02, 2002, and entitled "An Electrolytic and Electroless Process For Treating Metallic Surfaces And Products Formed Thereby"; the disclosure of each of the foregoing is hereby incorporated by reference.

DETAILED DESCRIPTION

The instant invention solves problems associated with conventional practices by providing an electroless or electrolytic process for treating metallic surfaces. The metal surface can possess a wide range of sizes and configurations, e.g., fibers, coils, sheets including perforated acoustic panels, chopped wires, drawn wires or wire strand/rope, rods, couplers (e.g., hydraulic hose couplings), fibers, particles, fasteners (including industrial and residential hardware), brackets, nuts, bolts, rivets, washers, cooling fins, stamped articles, powdered metal articles, among others. The limiting characteristic of the inventive process to treat a metal surface is dependent upon the ability of the surface to be contacted with the inventive medium.

The process employs a first medium comprising at least one silicate, and a second medium comprising colloidal silica. The metallic surface is exposed to the first medium and then to the second medium (additional processing steps can be employed before, between and after exposure to the first and second mediums). The first and second mediums can be electrolytic or electroless (e.g., as described in the previously identified Related Patents and Patent Applications). Normally, the first medium comprises an electrolytic environment whereas the second medium comprises an electroless environment. If desired, the metallic surface can be dried, rinsed and dried between exposure to the first and second mediums. Alternatively, the metallic surface may be removed from the first medium and exposed to the second medium without being dried.

The first medium of the inventive process can form silicate containing film or layer. The silicate containing film or layer can comprise a region comprising a monosilicate (e.g., zinc monosilicate) with a disilicate film upon the monosilicate region as well as combinations of monosilicate and disilicate. The silicate containing film or layer can range from about 10 to about 100 nanometers in thickness. The second medium of the inventive process can form a silica containing film or layer. The silica containing film or layer can comprise a region comprising monomeric silica or silica oligomers with a colloidal silica film upon the monomeric silica region as well as combinations of the monomeric and colloidal silica. The silica containing film or layer can range from about 500 to 800 nanometers in thickness. Notwithstanding the foregoing, the thickness of these films or layers can vary depending upon raw materials, concentrations, processing conditions, among other parameters. The silicate and silica containing films or layers can each contain metals, metal hydroxides, among other metal species that are distributed throughout these films or layers (e.g., a distribution of zinc hydroxide when treating a zinc metallic surface).

The first medium can comprise water and at least one water soluble silicate such as at least one member selected from the group of sodium silicate, potassium silicate, ammonium silicate, among other silicates, siliceous species such as monomeric silica, oligomeric silica, polymeric silica, colloidal silica, among other water soluble silicates and combinations thereof. While any suitable silicate can be employed, an example of suitable silicate comprises an oligomeric sodium silicate (e.g., available commercially from PQ Corporation as "D" grade sodium silicate). The oligomeric sodium silicate has a ratio of SiO2wt./Na2Owt of about 2.00 wherein the amount of NaOw/w % is about 13 to about 15 (e.g., about 14.7+–0.15) and the amount of SiO2w/wt. % is about 28 to about 30 (e.g., about 29.4). The amount of at least one water soluble silicate normally comprises about 1 to about 30 wt. % of the first medium. The siliceous species (e.g., colloidal silica, monomeric or oligomeric silica-containing species) can have any suitable size and, normally, range from about 0.5 to about 200 nanometers (e.g., about 0.5 to about 5 nanometers). The first medium has a pH of about 10 to 12 (e.g., about 11.5).

While desirable results can be obtained by using a polymeric silicate such as PQ N Grade sodium silicate, polymeric sodium silicate has a SiO2wt/Na2Owt ratio of 3:22 and a lower viscosity relative to oligomeric silicate. Further the oligomeric silicate has an increased electricity conductive relative to the polymeric which can be useful when the first medium is employed in an electrolytic environment.

The second medium can comprise water, at least one siliceous material and optionally at least one water soluble silicate (e.g., sodium silicate, potassium silicate, ammonium silicate, among other silicates). Examples of suitable siliceous materials comprise at least one member selected from the group of colloidal silica, monomeric silica, dimeric or oligomeric silica, among other polymeric forms of silica. While any suitable siliceous materials can be employed, examples of such materials comprise colloidal silica dispersed within water (e.g., commercially available as Ludox® CL [silica core with an alumina shell], LS [low sodium], HS [high sodium concentration or stabilized with sodium hydroxide] and AM [aluminum modified or stable at low pH]). The colloidal silica can have any suitable size and, normally, ranges from about 10 to about 50 nanometers (e.g., about 10–15 nanometers which corresponds to a surface area of about 220 m2/gram). The amount of siliceous material normally ranges from about 1 to about 75 wt. % of the second medium.

In addition to forming the silica film or layer, the second medium can treat micro-cracks that may be present in the silicate film or layer. Micro-cracks that may be present in the silicate film or layer are typically less than about 1 micron in width. Exposure to the second medium can fill, coat, modify or otherwise protect the micro-cracked surface (e.g., reduce corrosive agents from passing through the micro-cracks and adversely affecting the underlying metallic surface).

Colloidal silica (commercially available as Ludox® AM-30, HS-40, among others) can be employed in the first and second mediums. The colloidal silica has a particle size ranging from about 10 nm to about 50 nm. The size of particles in the medium ranges from about 10 nm to 1 micron and typically about 0.05 to about 0.2 micron (1 micron=1,000 nanometers). The medium has a turbidity of about 10 to about 700, typically about 50 to about 300 Nephelometric Turbidity Units (NTU) as determined in accordance with conventional procedures.

In one aspect of the invention, the first medium employs an electrolytic cathodic process for treating a metallic surface within an aqueous silicate-containing bath (e.g., a water dispersible silicate such as oligomeric sodium silicate [e.g., having a SiO2/Na2O ratio of about 2.0]), wherein the pH of the bath is greater than about 10 to 11.5 under conditions sufficient to cause hydrogen evolution at the cathode or work piece (e.g. such as described in U.S. patent application Ser. No. 09/814,641 or Ser. No. 10/211,094). The anode can comprise any suitable material such as platinum plated niobium or tungsten, nickel, iridium oxide, among other materials depending upon whether a dimensionally stable anode is desired. Without wishing to be bound by any theory or explanation, it is believed that the metallic surface interacts or reacts with the first medium to form a silicate containing film or layer (e.g., a product formed between the metallic surface and monomeric and oligomeric siliceous material that comprises the previously described disilicate and in the case of a zinc surface comprising zinc disilicate), and the second medium forms a silica containing film or layer that modifies (e.g., fills micro-cracks) the surface of the silicate containing film or layer. The specific electrolytic parameters depend upon the substrate to be treated, and the intended composition to be deposited. Normally, the temperature of the first medium ranges from about 25 to about 95 C. (e.g., about 75 C.), the voltage from about 6 to 24 volts, with a silicate solution concentration from about 1 to about 15 wt. % silicate, the current density ranges from about 0.025 A/in2 and greater than 0.60 A/in2 and typically about 0.04 A/in2 (e.g., about 180 to about 200 mA/cm2 and normally about 192 mA/cm2), contact time with the first medium from about 10 seconds to about 50 minutes and normally about 1 to about 15 minutes, and anode to cathode surface area ratio of about 0.5:1 to about 2:1.

Without wishing to be bound by any theory or explanation, it is believe that when the first medium is used in an electrolytic environment to treat a metallic surface the monomeric and oligomeric silicate species (e.g., obtained from sodium silicate having a SiO2/Na2O ratio of about 2), in the first medium react with the metallic surface (e.g, zinc plating), in a Helmholtz zone that is created immediately adjacent to a cathodic work piece. It is believed that a local relatively high pH is formed adjacent to the cathode as a result of electrolysis of water (i.e., hydrogen is evolved at the cathode), and, in some cases, elevated temperature of the first medium, metal ions from the metallic surface are released into the first medium and included in the silicate containing film or layer. It is further believed that a monomeric silicate film formation reaction occurs that is self-limiting, typical thickness is approximately 50 A. A second layer of disilicate can be formed and deposited upon the monomeric silicate (e.g., as described in Pages 83–94 of R. K. Iler, "The Chemistry of Silica: Solubility, Polymerization, Colloid and Surface Properties, and Biochemistry", John Wiley & Sons, NY, 1979; Page 86 of Englehardt and Michel, "High Resolution Solid State NMR of Silicates and Zeolites" John Wiley & Sons, NY 1987; and Bass and Turner "Anion Distribution In Sodium Silicate Solutions. Charateristization By Si29NMR And Infrared Spectroscopies And Vapor Phase Osmometry", Journal of Physical Chemistry B, 1997 Vol 101(50), Pages 10638 to 10644; all hereby incorporated by reference). A silica containing film or coating can then be deposited upon the disilicate film a monomeric silica species (e.g., monomeric or oligomeric siliceous species).

In another aspect of the invention, the first medium is employed as an electroless medium (e.g., in accordance with U.S. patent application Ser. Nos. 10/211,051 and 10/211,029). The metallic surface is exposed to an electroless first medium under conditions and for a time sufficient to form the silicate containing film or layer. If desired, the electroless medium can further comprise at least one reducing agent. An example of a suitable reducing agent comprises sodium borohydride, phosphorus compounds such as hypophosphide compounds, phosphate compounds, among others. Without wishing to be bound by any theory or explanation, it is believed that the reducing agent may reduce water present in the silicate medium thereby modifying the surface pH of articles that contact the silicate medium (e.g., article may induce or catalyze activity of the reducing agent). According to one embodiment, the concentration of sodium borohydride is typically 1 gram per liter of bath solution to about 20 grams per liter of bath solution more typically 5 grams per liter of bath solution to about 15 gram per liter of bath solution. In one illustrative embodiment, 10 grams of sodium borohydride per liter of bath solution is utilized. When employed the reducing agent, can cause hydrogen evolution once the bath/medium has been sufficiently heated.

After being contacted with an electrolytic or electroless first medium, the metallic surface contacts the second medium under conditions and for a period of time sufficient to form the silica containing film or layer. While any suitable environment can be employed in the second medium, normally this medium is electroless. If desired, the metallic surface can be dried, rinsed (e.g., with water), and dried prior to contact with the second medium. Alternatively, the metallic surface can exit the first medium and directly contact the second medium, or be dried (without rinsing) prior to contacting the second medium. As a further alternative, a metallic surface treated by the first medium can be treated further by exposure to multiple second mediums having the same or different composition thereby permitting the characteristics of the metallic surface to be tailored. As described below in greater detail, at least one secondary coating or film can be applied upon the silica containing film or layer (e.g, epoxy, acrylic, polyurethane, silane, among other coatings).

In an aspect of the invention, the silicate containing and silica containing films or layers can be enhanced by employing multiple steps. The inventive process separates the silicate containing film deposition or formation process from the silica containing film deposition or formation process as shown in the Table below.

TABLE

| 1. Clean | 2. Rinse | 3. First | 4. Rinse | 5. Second | 6. Dry | 7. Rinse: | 8. Dry |
|---|---|---|---|---|---|---|---|
| | Multiple Include Cleaning | Media: Cathodic Oligomeric Silicate (D-Grade) | : DI water | Medium: Collodial Silica Immersion Ludox CL Ludox LP Ludox HS | | DI water plus colloidal silica (Ludox) to modify | |

TABLE-continued

| 1. Clean | 2. Rinse | 3. First | 4. Rinse | 5. Second | 6. Dry | 7. Rinse: | 8. Dry |
|---|---|---|---|---|---|---|---|
| | | | | Ludox AM | | micro-cracks | |
| | | | Process Flow → | | | | |

The above process enhances the disilicate formation in step 3 (i.e., the aforementioned cathodic process), by precleaning the work piece to remove oxides and cathodic films, carbonates, sulphates, and chlorides. By cleaning the metallic surface before entering the first medium, it is believed that fewer impurities will be present in the cathodic process which in turn minimizes material that can function as colloidal silica nucleation sites. Step 4 comprises a rinse to remove any residual or undesirable material (e.g., step 4 may comprise a water rinse, or an acidic or other reactive rinse). Step 5 may have a composition similar to the bath of step 3 or contain dopants that enhance formation (e.g., deposition or precipitation) of the silica containing film or layer. Examples of suitable dopants that can be included in step 5 comprise nickel, aluminum, among other corrosion resistant metals. The metallic surface or step 5 medium can be heated to about 55° C. to about 90° C. Step 6 is employed for dehydrating and improving the stability of at least one of the silicate and silica containing films. Step 6 can be conducted at 70–120° C.

Step 5 or 7 can include a colorant or dye for monitoring uniformity of coating, enhancing appearance of the treated component, among other purposes. If desired, the rinsing Step 7 can include a compound such as colloidal silica (e.g., commercially available as Ludox® AM), that interacts or reacts with the silicate or silica containing films.

When employing the first medium of Step 3 above to treat metallic surfaces, colloidal material (e.g., colloidal silica) can be generated in the first medium. If the colloids become relatively large or concentrated, the first medium can be replaced. The first medium, which contains a relatively large concentration of colloidal material, can be employed as the second medium in Step 5.

The first and/or second mediums of the inventive process can be operated on a batch or continuous basis. The type of process will depend upon the configuration of the metal being treated. The contact time within the medium ranges from about 10 seconds to about 50 minutes and normally about 1 to about 15 minutes. The inventive process can be practiced in any suitable apparatus. Examples of suitable apparatus comprise a conventional barrel dip apparatus (e.g., metallic components are placed in a perforated rotating barrel and then contacted with the mediums).

The first and second mediums can be a fluid bath, gel, spray, among other methods for contacting the substrate with the medium. The mediums can comprise any suitable polar carrier such as water, alcohol, ethers, at least one water dispersible polymer, among others. The mediums can be agitated (e.g., by a circulation pump), heated (e.g., with immersion heaters), filtered (e.g., with a 1 micron filter), among other processes associated with operating and maintaining metal finishing chermistry and equipment.

The first and second mediums can be modified by adding water or polar carrier dispersible or soluble polymers. If utilized, the amount of polymer or water dispersible materials normally ranges from about 0 wt. % to about 10 wt. %. Examples of polymers or water dispersible materials that can be employed in the medium comprise at least one member selected from the group of acrylic copolymers (supplied commercially as Carbopol®), hydroxyethyl cellulose, clays such as bentonite, among others.

In an aspect of the invention, the first and second mediums are modified to include at least one dopant material. The dopants can be useful for building additional thickness of the deposited layer. The amount of dopant can vary depending upon the properties of the dopant and desired results. Typically, the amount of dopant will range from about 0.001 wt. % to about 5 wt. % (or greater so long as the deposition rate is not adversely affected). Examples of suitable dopants comprise at least one member selected from the group of water soluble salts, oxides and precursors of tungsten, molybdenum, titanium (titatantes), zircon, vanadium, phosphorus, aluminum (aluminates), iron (e.g., iron chloride), boron (borates), bismuth, gallium, tellurium, germanium, antimony, niobium (also known as columbium), magnesium and manganese, sulfur, zirconium (zirconates) mixtures thereof, among others, and usually, salts and oxides of aluminum and iron, and other water soluble or dispersible monovalent species. The dopant can comprise at least one of molybdenic acid, fluorotitanic acid and salts thereof such as titanium hydrofluoride, ammonium fluorotitanate, ammonium fluorosilicate and sodium fluorotitanate; fluorozirconic acid and salts thereof such as $H_2ZrF_6$, $(NH_4)_2ZrF_6$ and $Na_2ZrF_6$; among others. Alternatively, dopants can comprise at least one substantially water insoluble material such as electropheritic transportable polymers, PTFE, boron nitride, silicon carbide, silicon nitride, aluminum nitride, titanium carbide, diamond, titanium diboride, tungsten carbide, metal oxides such as cerium oxide, powdered metals and metallic precursors such as zinc, among others. The aforementioned dopants can be employed for enhancing the silicate and/or silica containing layer formation rate, modifying the chemistry and/or physical properties of the resultant layer, as a diluent for the medium, among others. Examples of such dopants are iron salts (ferrous chloride, sulfate, nitrate), aluminum fluoride, fluorosilicates (e.g., K2SiF6), fluoroaluminates (e.g., potassium fluoroaluminate such as K2AlF5-H2O), mixtures thereof, among other sources of metals and halogens. The dopant materials can be introduced to the metal surface in pretreatment steps, in post treatment steps (e.g., rinse), and/or by alternating exposing the metal surface to solutions of dopants and solutions of the mediums. The presence of dopants in these mediums can be employed to form tailored surfaces upon the metal, e.g., an aqueous solution containing aluminate can be employed to form a layer comprising oxides of boron and aluminum. That is, at least one dopant (e.g., a zinc containing species such as zinc hydroxide) can be co-deposited along with at least one water soluble species upon the substrate.

The first and second mediums can also be modified by adding at least one diluent. Examples of suitable diluent comprise at least one member selected from the group of sodium sulphate, surfactants, de-foamers, colorants/dyes, conductivity modifiers, among others. The diluent (e.g., sodium sulfate) can be employed for reducing the affects of contaminants entering the medium, reducing bath foam, among others. When the diluent is employed as a defoamer, the amount normally comprises less than about 5 wt. % of the medium, e.g., about 1 to about 2 wt. %.

Contact with the inventive mediums can be preceded by and/or followed with conventional pre-treatments and/or post-treatments known in this art such as cleaning or rinsing, e.g., immersion/spray within the treatment, sonic cleaning, double counter-current cascading flow; alkali or acid treatments, among other treatments. By employing a suitable post- or pre-treatment the solubility, corrosion resistance (e.g., reduced white rust formation when treating zinc containing surfaces), sealer and/or topcoat adhesion, among other properties of treated metallic surface formed by the inventive method can be improved. If desired, the post-treated surface can be sealed, rinsed and/or topcoated, e.g., silane, epoxy, latex, fluoropolymer, acrylic, among other coatings.

In one aspect of the invention, a pre-treatment comprises exposing the substrate to be treated to at least one of an acid, oxidizer, a basic solution (e.g., zinc and sodium hydroxide) among other compounds. The pre-treatment can be employed for removing excess oxides or scale, equipotentialize the surface for subsequent mineralization treatments, convert the surface into a silicate containing or silica containing precursor, among other benefits. Conventional methods for acid cleaning metal surfaces are described in ASM, Vol. 5, Surface Engineering (1994), and U.S. Pat. No. 6,096,650; hereby incorporated by reference.

In another aspect of the invention, the metal surface is pre-treated or cleaned electrolytically by being exposed to an anodic environment. That is, the metal surface is exposed to the medium wherein the metal surface is the anode and a current is introduced into the medium. If desired, anodic cleaning can occur in the first medium. By using the metal as the anode in a DC cell and maintaining a current of about 10 A/ft2 to about 150 A/ft2, the process can generate oxygen gas. The oxygen gas agitates the surface of the workpiece while oxidizing the substrate's surface. The surface can also be agitated mechanically by using conventional vibrating equipment. If desired, the amount of oxygen or other gas present during formation of the mineral layer can be increased by physically introducing such gas, e.g., bubbling, pumping, among other means for adding gases.

If desired, the inventive method can include a thermal post-treatment following exposure to the second medium(s). The metal surface can be removed from the second medium, dried (e.g., at about 120 to about 150 C. for about 2.5 to about 10 minutes), rinsed in deionized water and then dried. The dried surface may be processed further as desired; e.g. contacted with a sealer, rinse or topcoat. In an aspect of the invention, the thermal post treatment comprises heating the surface. Typically the amount of heating in drying steps herein is sufficient to consolidate or densify the inventive surface without adversely affecting the physical properties of the underlying metal substrate. Heating can occur under atmospheric conditions, within a nitrogen containing environment, among other gases. Alternatively, heating can occur in a vacuum. The surface may be heated to any temperature within the stability limits of the surface coating and the surface material. Typically, surfaces are heated from about 75° C. to about 250° C., more typically from about 120° C. to about 200° C. If desired, the heat treated component can be rinsed in water to remove any residual water soluble species and then dried again (e.g., dried at a temperature and time sufficient to remove water).

In one aspect of the invention, the post treatment comprises exposing the substrate to a source comprising at least one acid source or precursors thereof. Examples of suitable acid sources comprise at least one member chosen from the group of phosphoric acid, hydrochloric acid, molybdic acid, silicic acid, acetic acid, citric acid, nitric acid, hydroxyl substituted carboxylic acid, glycolic acid, lactic acid, malic acid, tartaric acid, ammonium hydrogen citrate, ammonium bifluoride, fluoboric acid, fluorosilicic acid, among other acid sources effective at improving at least one property of the treated metal surface. The pH of the acid post treatment may be modified by employing at least one member selected from the group consisting of ammonium citrate dibasic (available commercially as Citrosol® #503 and Multiprep®), fluoride salts such as ammonium bifluoride, fluoboric acid, fluorosilicic acid, among others. The acid post treatment can serve to activate the surface thereby improving the effectiveness of rinses, sealers and/or topcoatings (e.g., surface activation prior to contacting with a sealer can improve cohesion between the surface and the sealer thereby improving the corrosion resistance of the treated substrate). Normally, the acid source will be water soluble and employed in amounts of up to about 15 wt. % and typically, about 1 to about 5 wt. % and have a pH of less than about 5.5.

In another aspect of the invention, a rinse between the first and second mediums or a rinse employed as a post treatment comprises contacting a surface treated by the inventive process with a rinse. By "rinse" it is meant that an article or a treated surface is sprayed, dipped, immersed or other wise exposed to the rinse in order to affect the properties of the treated surface. For example, a surface treated by the inventive process is immersed in a bath comprising at least one rinse. In some cases, the rinse can interact or react with at least a portion of the treated surface. Further the rinsed surfaced can be modified by multiple rinses, heating, topcoating, adding dyes, lubricants and waxes, among other processes. Examples of suitable compounds for use in rinses comprise at least one member selected from the group of titanates, titanium chloride, tin chloride, zirconates, zirconium acetate, zirconium oxychloride, fluorides such as calcium fluoride, tin fluoride, titanium fluoride, zirconium fluoride; coppurous compounds, ammonium fluorosilicate, metal treated silicas (e.g., Ludox®), nitrates such as aluminum nitrate; sulphates such as magnesium sulphate, sodium sulphate, zinc sulphate, and copper sulphate; lithium compounds such as lithium acetate, lithium bicarbonate, lithium citrate, lithium metaborate, lithium vanadate, lithium tungstate, among others. The rinse can further comprise at least one organic compound such as vinyl acrylics, fluorosurfactancts, polyethylene wax, among others. One specific rinse comprises water, water dispersible urethane, and at least one silicate, e.g., refer to commonly assigned U.S. Pat. No. 5,871,668; hereby incorporated by reference. While the rinse can be employed neat, normally the rinse will be dissolved, diluted or dispersed within another medium such as water, organic solvents, among others. While the amount of rinse employed depends upon the desired results, normally the rinse comprises about 0.1 wt. % to about 50 wt. % of the rinse medium. The rinse can be employed as multiple applications and, if desired, heated. Moreover, the aforementioned rinses can be modified by incorporating at least one dopant, e.g. the aforementioned dopants. The dopant can employed for interacting or reacting with the treated surface. If desired, the dopant can be dispersed in a suitable medium such as water and employed as a rinse.

If desired, after rinsing at least one coating can be applied. Examples of suitable such coatings comprise at least one member selected from the group of Aqualac® (urethane containing aqueous solution), W86®, W87®, B37®, T01®, E10®, B17, B18 among others (a heat cured coating supplied by the Magni® Group), JS2030S (sodium silicate containing rinse supplied by MacDermid Incorporated), JS2040I (a molybdenum containing rinse also supplied by MacDermid Incorporated), EnSeal® C-23 (an acrylic based coating supplied by Enthone), EnSeal® C-26, Enthone® C-40 (a pigmented coating supplied Enthone), Microseal®, Paraclene® 99 (a chromate containing rinse), EcoTri® (a silicate/polymer rinse), MCI Plus OS (supplied by Metal Coatings International), silanes (e.g., Dow Corning Z-6040, Gelest SIA 0610.0, tetra-ortho-ethyl-silicate (TEOS), tetramethylorthosilicate (TMOS), bis-1,2-(triethoxysilyl) ethane (BSTE), vinyl silane or aminopropyl silane, epoxy silanes, vinyltriactosilane, alkoxysilanes, among other organo functional silanes), ammonium zirconyl carbonate (e.g., Bacote 20), urethanes (e.g., Agate L18-18 and L18-79P), acrylic coatings (e.g., IRILAC®), e-coats, silanes including those having amine, acrylic and aliphatic epoxy functional groups, latex, urethane, epoxies, silicones, alkyds, phenoxy resins (powdered and liquid forms), radiation curable coatings (e.g., UV curable coatings), lacquer, shellac, linseed oil, among others. Coatings can be solvent or water borne systems. These coatings can be applied by using any suitable conventional method such as immersing, dip-spin, spraying, among other methods. The secondary coatings can be cured by any suitable method such as UV exposure, heating, allowed to dry under ambient conditions, among other methods. An example of UV curable coating is described in U.S. Pat. Nos. 6,174,932; 6,057,382; 5,759,629; 5,750,197; 5,539,031; 5,498,481; 5,478,655; 5,455,080; and 5,433,976; hereby incorporated by reference. The secondary coatings can be employed for imparting a wide range of properties such as improved corrosion resistance to the underlying mineral layer, reduce torque tension, a temporary coating for shipping the treated work-piece, decorative finish, static dissipation, electronic shielding, hydrogen and/or atomic oxygen barrier, among other utilities. The treated and coated metal, with or without the secondary coating, can be used as a finished product or a component to fabricate another article.

The thickness of the rinse, sealer and/or topcoat can range from about 0.00001 inch to about 0.025 inch. The selected thickness varies depending upon the end use of the coated article. In the case of articles having close dimensional tolerances, e.g., threaded fasteners, normally the thickness is less than about 0.00005 inch.

The inventive process can provide a surface that improves adhesion between a treated substrate and an adhesive. Examples of adhesives comprise at least one member selected from the group consisting of hot melts such as at least one member selected from the group of polyamides, polyimides, butyls, acrylic modified compounds, maleic anhydride modified ethyl vinyl acetates, maleic anhydride modified polyethylenes, hydroxyl terminated ethyl vinyl acetates, carboxyl terminated ethyl vinyl acetates, acid terpolymer ethyl vinyl acetates, ethylene acrylates, single phase systems such as dicyanimide cure epoxies, polyamide cure systems, lewis acid cure systems, polysulfides, moisture cure urethanes, two phase systems such as epoxies, activated acrylates polysulfides, polyurethanes, among others. Two metal substrates having surfaces treated in accordance with the inventive process can be joined together by using an adhesive. Alternatively one substrate having the inventive surface can be adhered to another material, e.g., joining treated metals to plastics, ceramics, glass, among other surfaces. In one specific aspect, the substrate comprises an automotive hem joint wherein the adhesive is located within the hem.

While the above description places particular emphasis upon forming a mineral containing layer upon a metal surface, the inventive process can be combined with or replace conventional metal pre or post treatment and/or finishing practices. Conventional post coating baking methods can be employed for modifying the physical characteristics of the treated metal surface, remove water and/or hydrogen, among other modifications. The treated metal surface of the invention can be employed to protect a metal finish from corrosion thereby replacing conventional phosphating process, e.g., in the case of automotive metal finishing the inventive process could be utilized instead of phosphates and chromates and prior to coating application e.g., E-Coat. The inventive process can be employed for imparting enhanced corrosion resistance to electronic components. The inventive process can also be employed in a virtually unlimited array of end-uses such as in conventional plating operations as well as being adaptable to field service. For example, the inventive silica containing coating can be employed to fabricate corrosion resistant metal products that conventionally utilize zinc as a protective coating, e.g., automotive bodies and components, grain silos, bridges, among many other end-uses. Moreover, depending upon the dopants and concentration thereof present in the mineral deposition solution, the inventive process can produce microelectronic films, e.g., on metal or conductive surfaces in order to impart enhanced electrical/magnetic (e.g., EMI shielding, reduced electrical connector fretting, reduce corrosion caused by dissimilar metal contact, among others), and corrosion resistance, or to resist ultraviolet light and monotomic oxygen containing environments such as outer space.

The following Examples are provided to illustrate certain aspects of the invention and it is understood that such an Example does not limit the scope of the invention.

EXAMPLES

An inventive process employing the first and second mediums is illustrated by the following examples wherein the aforementioned cathodic process was conducted to obtain a disilicate film and thereafter the work piece was maintained in the bath without current in order to obtain a silica containing film upon the disilicate. These examples were conducted in a commercially available and lab scale barrel system. The work piece comprised a cylindrical component that had been plated with alkaline zinc.

Example 1

The integrity of the disilicate and silica films was tested by exposing the treated work piece to lead acetate. Any exposed or uncoated zinc will react with lead acetate and form a black product that is visually detectable.

Constants:

Cathodic Process Bath Temp 75±2 deg. C.

Bath Comprised 10 wt. % sodium silicate (SiO2:Na2O ratio 3:22) in deionized water Post-Cathodic Process Dry For 6 min @ 120 deg. C.

Rinse deionized water

Dry 2 min @ 120 deg C.

| No. | Current | Current Density | Voltage | Time | Post-Treatment |
|---|---|---|---|---|---|
| | | Group "A" | | | |
| A1 | 5.0 A | 1.0 ASI | 8 V | 45 sec | none |
| A2 | 4.8 A | 0.96 ASI | 8 V | 45 sec | none |
| A3 | 4.8 A | 0.96 ASI | 8 V | 45 sec | $H_2O$ |
| A4 | 4.8 A | 0.96 ASI | 8 V | 45 sec | $H_2O$ |
| A5 | 4.7 A | 0.94 ASI | 8 V | 45 sec | NaOH |
| A6 | 4.7 A | 0.94 ASI | 8 V | 45 sec | NaOH |
| | | Group "B" | | | |
| B1 | 0.35 A | 0.07 ASI | ~2.5 V | 15 min | none |
| B2 | 0.35 A | 0.07 ASI | ~2.5 V | 15 min | none |
| B3 | 0.35 A | 0.07 ASI | ~2.5 V | 15 min | $H_2O$ |
| B4 | 0.35 A | 0.07 ASI | ~2.5 V | 15 min | $H_2O$ |
| B5 | 0.35 A | 0.07 ASI | ~2.5 V | 15 min | NaOH |
| B6 | 0.35 A | 0.07 ASI | ~2.5 V | 15 min | NaOH |

Lead Acetate Exposure Results:
A1 - 5% black spotting
A2 - 5% black spotting
A3 - 33% black spotting
A4 - 33% black spotting
A5 - no spotting (part darkened slightly in NaOH, then no change in lead acetate)

-continued

| No. | Current | Current Density | Voltage | Time | Post-Treatment |
|---|---|---|---|---|---|

A6 - no spotting (part darkened slightly in NaOH, then no change in lead acetate)
B1 - 5% black spotting
B2 - 33% black spotting
B3 - 90% black spotting
B4 - 5% black spotting
B5 - 100% black spotting (part darkened slightly in NaOH, then turned black in lead acetate)
B6 - 100% black spotting (part darkened slightly in NaOH, then turned black in lead acetate)
Observations:
Coating produced by Group A is partially stripped with boiling water, but not with boiling 5% NaOH (parts darken, but lead acetate has no effect).
Coating produced by Group B is more reactive with lead acetate (5% and 33% spotting vs. 5% and 5% spotting).

Example 2

This Example illustrates the affect of chloride on the cathodic silicate bath (10 wt. % N Grade sodium silicate supplied by PQ Corporation having a SiO2/Na2O ratio of 3:22). The work pieces were exposed to the cathodic process in a conventional and commercially available barrel system. Certain of the work pieces were maintained in the bath subsequent to the cathodic process and prior to drying in order to enhance formation of a silica rich mineraloid film upon the disilicate film. These pieces were rotated in the bath without current.

Constants:

Alkaline Zinc Plated Work Pieces

Cathodic process bath parameters: 8V, 45 sec, 75 deg. C., ~7 to 8 Amps

Post Cathodic Process Bath: Dry 6 min. 120 deg. C.—D.I. Rinse—Dry 2 min. 120 deg. C.

The work pieces were processed as indicated in the table below in a cathodic bath having the following chloride bath additions: 100, 500, and 1000 ppm chloride as sodium chloride and separately, as zinc chloride. Sodium chloride readily dissolved in the cathodic bath, caused no colloids to form. Zinc chloride instantly produces colloids in the cathodic bath, but coating from solutions containing this compound produced inferior salt spray. The zinc chloride containing solution was ultrasonically agitated and then magnetically stirred and produced bath having a milky-white appearance.

Effect of Chloride Bath Addition and Continued Rotation on Salt Spray Performance:

| Part ID | $Cl^-$ | $Cl^-$ source | Agitation* | Temp □C | Volts | Amps | Rotate In Bath Without Current** | 8 hr Salt Spray-ASTM B117 |
|---|---|---|---|---|---|---|---|---|
| I | 100 ppm | NaCl | No | 78 | 8 | 7.0 | No | 25% WC |
| II | A | NaCl | Yes | 77 | 8 | 7.0 | No | 25% WC |
| III | A | $ZnCl_2$ | No | 78 | 8 | 7.0 | No | 25% WC |
| IV | A | $ZnCl_2$ | Yes | 79 | 8 | 7.2 | No | 25% WC |
| V | A | $ZnCl_2$ | No | 79 | 8 | 6.8 | Yes | 33% WC |
| VI | A | $ZnCl_2$ | Yes | 79 | 8 | 7.0 | Yes | 40% WC |
| VII | 500 ppm | NaCl | No | 74 | 8 | 7.2 | No | 33% WC |
| VIII | A | NaCl | Yes | 75 | 8 | 7.6 | No | 33% WC |
| IX | A | $ZnCl_2$ | No | 78 | 8 | 6.2 | No | 5% WC |
| X | A | $ZnCl_2$ | Yes | 77 | 8 | 5.8 | No | 15% WC |
| XI | A | $ZnCl_2$ | No | 78 | 8 | 6.2 | Yes | 25% WC |
| XII | A | $ZnCl_2$ | Yes | 82 | 8 | 6.0 | Yes | 25% WC |
| XIII | 1000 ppm | NaCl | No | 74 | 8 | 8.0 | No | 3% WC |
| XIV | A | NaCl | Yes | 74 | 8 | 8.0 | No | 20% WC |
| XV | A | $ZnCl_2$ | Yes | 76 | 8 | 8.4 | No | 10% WC |
| XVI | A | $ZnCl_2$ | No | 80 | 8 | 6.2 | No | 10% WC |
| XVII | A | $ZnCl_2$ | No | 82 | 8 | 5.8 | Yes | 10% WC |
| XVIII | A | $ZnCl_2$ | Yes | 82 | 8 | 5.0 | Yes | 20% WC |

*Agitation via magnetic mixer during electrolysis.
**Rotate two pieces together in a plastic beaker with ~100 ml solution for two minutes.
Dry 120 deg. C., 6 min, DI Rinse, Dry 120 deg. C. 2 min.
WC = White Crust

Example 3

This Example demonstrates treating zinc plated rivets in an electrolytic first medium (Bath 1) comprising sodium silicate having two ratios of SiO2 to Na2O, and a second medium (Bath 2) comprising colloidal silica. S1 through S6 list the first occurrence of white rust corrosion products when of each part when tested in accordance with ASTM B-117 (NSS or neutral salt spray). The results of the treatment are listed in the table below. This table demonstrates that improved corrosion resistance can be achieved by selecting an appropriate first medium, second medium and drying temperature.

| NSS Group # | | Pretreat | Bath 1 | Bath 1 Temp | Bath 2 Age | Bath 2 Temp | Bath 2 Time | Bath 2 Rotation | S1 | S2 | S3 | S4 | S5 | S6 | Average NSS |
|---|---|---|---|---|---|---|---|---|---|---|---|---|---|---|---|
| 1 | | No | 10% N | 55 | | | | | 48 | 72 | 72 | 72 | 72 | | 67.2 |
| 1A | | No | 10% N | 55 | Old | 75 | 12 | 4 | 288 | 360 | 288 | 360 | 288 | 72 | 276 |
| 2 | | No | 10% D | 55 | | | | | 48 | 48 | 24 | 24 | 48 | 24 | 36 |
| 2A | (CD 0.022 ASI (0.58 A) 1 minute) | No | 10% D | 55 | Mid | 55 | 12 | 20 | 48 | 72 | 72 | 72 | 72 | 48 | 64 |
| 2B | (CD 0.022 ASI (0.58 A) 1 minute) | No | 10% D | 55 | | | | | 96 | 48 | 144 | 48 | 48 | | 76.8 |
| 2C | | No | 10% D | 55 | Mid | 55 | 12 | 20 | 144 | 72 | 144 | 144 | 192 | 192 | 148 |
| 3 | | No | 10% N | 75 | | | | | 192 | 144 | 72 | 72 | 216 | 144 | 140 |
| 3A | | No | 10% N | 75 | Mid | 75 | 12 | 4 | 72 | 72 | 72 | 96 | 72 | 96 | 80 |
| 3B | | No | NONE | NONE | Mid | 75 | 12 | 4 | 192 | 192 | 96 | 96 | 96 | 120 | 132 |
| 4 | | No | 25% D | 55 | | | | | 72 | 48 | 48 | 24 | 24 | 48 | 44 |
| 4A | | No | 25% D | 55 | Old | 55 | 12 | 20 | 96 | 96 | 120 | 72 | 72 | 72 | 88 |
| 5 | | No | 10% D | 55 | | | | | 48 | 48 | 48 | 24 | 24 | 24 | 36 |
| 5A | | No | 10% D | 55 | New | 75 | 2 | 20 | 144 | 48 | 72 | 72 | 72 | 72 | 80 |
| 8 | | No | 10% N | 55 | | | | | 72 | 72 | 288 | 96 | 264 | 96 | 148 |
| 8A | | No | 10% N | 55 | New | 75 | 2 | 20 | 240 | 216 | 312 | 288 | 72 | 168 | 216 |
| 8B | | No | NONE | NONE | New | 75 | 2 | 20 | 192 | 192 | 192 | 192 | 192 | 192 | 192 |
| 9 | | Yes | 25% D | 55 | | | | | 48 | 48 | 48 | 24 | 24 | 24 | 36 |
| 9A | | Yes | 25% D | 55 | Mid | 75 | 2 | 4 | 288 | 312 | 24 | 312 | 120 | 192 | 208 |
| 10 | | No | 17.5% D | 75 | | | | | 48 | 144 | 168 | 48 | 120 | 168 | 116 |
| 10A | | No | 17.5% D | 75 | Old | 75 | 2 | 4 | 312 | 264 | 72 | 240 | 312 | 72 | 212 |
| 11 | | Yes | 10% N | 75 | | | | | 48 | 120 | 96 | 72 | 48 | | 76.8 |
| 11A | | Yes | 10% N | 75 | Old | 55 | 2 | 20 | 168 | 72 | 120 | 168 | 96 | 168 | 132 |
| 12 | | No | 10% D | 75 | | | | | 24 | 48 | 24 | 24 | 48 | 24 | 32 |
| 12A | (CD 0.022 ASI (0.58A) 1 minute) | No | 10% D | 75 | Mid | 55 | 2 | 20 | 144 | 96 | 120 | 336 | 168 | 96 | 160 |
| 12B | (CD 0.022 ASI (0.58A) 1 minute) | No | 10% D | 75 | | | | | 72 | 48 | 24 | 48 | 24 | | 43.2 |
| 12C | | No | 10% D | 75 | Mid | 55 | 2 | 20 | 144 | 168 | 144 | 120 | 72 | 48 | 116 |
| 13 | | Yes | 10% D | 55 | | | | | 96 | 24 | 48 | 48 | 72 | 72 | 60 |
| 13A | | Yes | 10% D | 55 | Old | 55 | 2 | 4 | 48 | 48 | 96 | 192 | 120 | | 100.8 |
| 15 | | Yes | 17.5% D | 55 | | | | | 24 | 24 | 24 | 48 | 48 | 48 | 36 |
| 15A | | Yes | 17.5% D | 55 | Old | 75 | 12 | 20 | 264 | 120 | 312 | 312 | 312 | 168 | 248 |
| 17 | | Yes | 10% N | 55 | | | | | 72 | 168 | 96 | 72 | 72 | 72 | 92 |
| 17A | | Yes | 10% N | 55 | Mid | 55 | 12 | 4 | 96 | 168 | 96 | 72 | 72 | 168 | 112 |
| 17B | | Yes | NONE | NONE | Mid | 55 | 12 | 4 | 192 | 192 | 144 | 96 | 48 | 192 | 144 |
| 18 | | Yes | 25% D | 75 | | | | | 168 | 24 | 72 | 96 | 48 | 72 | 80 |
| 18A | | Yes | 25% D | 75 | Mid | 75 | 2 | 20 | 48 | 144 | 144 | 96 | 72 | 48 | 92 |
| 19 | (1 minute, 0.58–0.60 A@ 4 V - 0.022ASI) | Yes | 10% D | 55 | | | | | 24 | 24 | 24 | 48 | 48 | 24 | 32 |
| 20 | (1 minute, 0.28–0.30 A@ 3 V - 0.011ASI) | Yes | 10% D | 55 | | | | | 48 | 24 | 48 | 96 | 96 | 24 | 56 |
| 21 | (2 minute - 0.6 Amps - 0.022ASI) | ?? | 5% D | 55 | | | | | 24 | 72 | 72 | 24 | 96 | 48 | 56 |
| 22 | (1 minute - 0.6 Amps - 0.022ASI) | ?? | 5% D | 55 | | | | | 24 | 24 | 24 | 24 | 24 | 24 | 24 |
| 23 | | | | | | | | | 24 | 24 | (2 Samples) | | | | 24 |
| 24 | | | | | | | | | 24 | 24 | 24 | | 24 | 24 | 24 |
| 25 | | | | | | | | | 24 | 24 | 24 | | 24 | 24 | 24 |
| Control (24 pieces) that were processed by treating in Bath 1. | | | | 24<br>72 | 24<br>120 | 24<br>120 | 48<br>120 | 48<br>120 | 48<br>120 | 48<br>144 | 48<br>144 | 48<br>144 | 48<br>144 | 72<br>144 | 72<br>144 |
| | | Average = 87 hours | | | | | | | | | | | | | |

NOTES:

A-Bath 1: 4 minutes, 0.045 A/in2, constant current, in Rotating Barrel (measuring 6 "length and 3" in diameter).

B-D-grade sodium silicate was more conductive and, therefore, had a lower voltage at constant current.

C-Dry 1: 120C for 20 minutes. Shake the water off. Ensure the parts are dried in a basket that allows free flow of air.

D-Dry 2: Same as Dry 1.

-continued

| NSS Group # | Pretreat | Bath 1 | Bath 1 Temp | Bath 2 Age | Bath 2 Temp | Bath 2 Time | Bath 2 Rotation | S1 | S2 | S3 | S4 | S5 | S6 | Average NSS |
|---|---|---|---|---|---|---|---|---|---|---|---|---|---|---|

E-Do not rinse between Bath 1 and Bath 2.
F-Bath 2 "Old" = Turbidity of 900 to 1,000 NTU
Bath 2 "Mid" = Turbidity of 200 to 400 NTU
Bath 2 "New" = Turbidity of approximately 10 NTU
Turbidity measurements are performed using a commercially available Turbidimeter (LaMotte model 2020). Turbidity was measured by using the Tyndall Effect by looking at the backscatter of light. The filtered turbidity was measured in the same way but on solutions that were filtered through a 1.2 micrometer filter paper.

Example 4

This Example demonstrates an electroless first medium that includes a reducing agent, and a second medium comprising colloidal silica. The second medium reduces, if not eliminates, micro-cracks that may be formed on the surface after contact with the first medium.

The first medium comprised water, sodium silicate (N-Grade SiO2/Na2O ratio 3:22) and sodium borohydride. The ratio of water to sodium silicate was 3:1. A zinc panel (supplied by ACT) was cleaned with alkali and immersed in the first medium substantially in accordance with Example 4 of U.S. patent application Ser. No. 10/211,051; hereby incorporated by reference.

The panel was dried in order to remove water (i.e., at 120 C.), rinsed to remove any water soluble species on the surface and dried again. As illustrated in FIG. 1, which is an SEM photomicrograph, of the surface of the panel treated in the first medium. FIG. 1 shows that the surface was micro-cracked.

Figure 2:
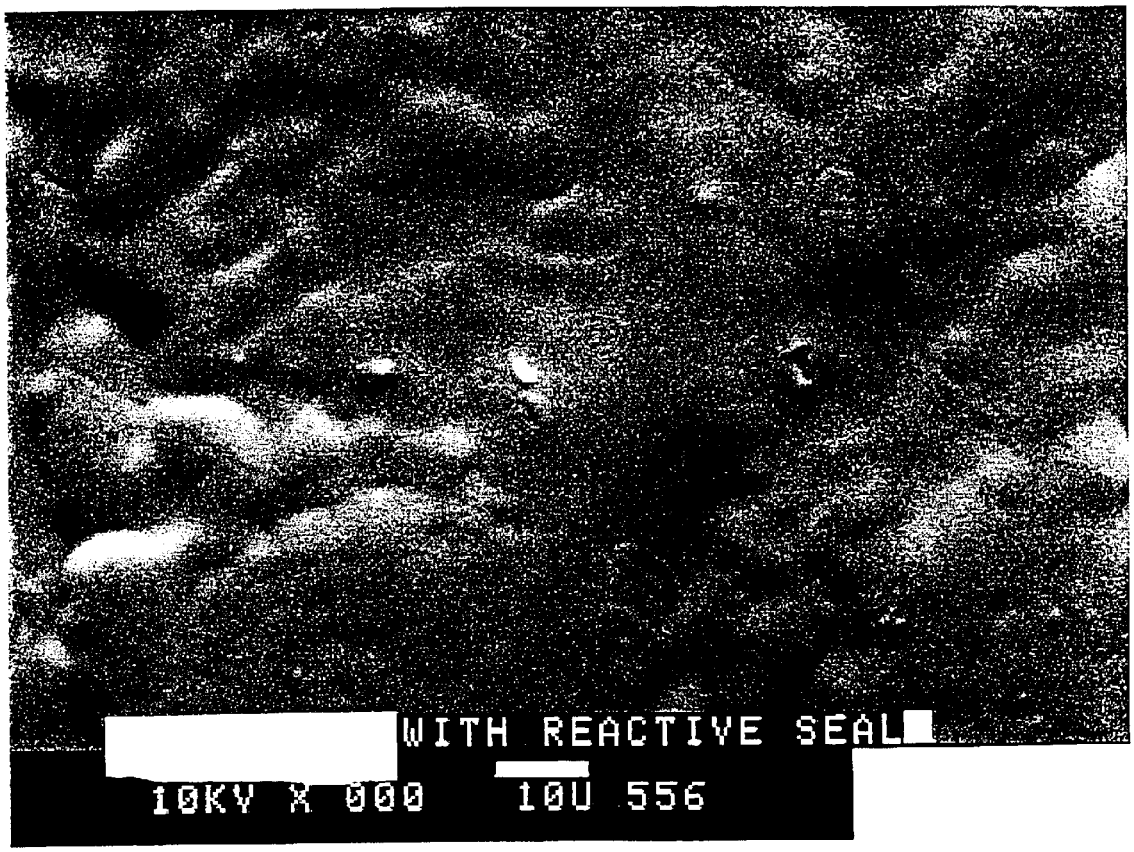
FIG. 2 is a comparative SEM photomicrograph of the surface illustrated in FIG. 1 that was exposed to a second medium comprising colloidal silica.

The panel was then exposed to a second medium comprising water and colloidal silica (i.e., 80 wt. % deionized water and 20 wt. % Ludox® AM30). The second medium was heated to a temperature of about 80 C. prior to immersing and agitating the panel in the heated second medium for about 1 minute. The panel was removed from the second medium, dried in air for about 5 seconds, oven dried at 120 C. for 4 minutes and rinsed with tap water for 15 seconds. As illustrated by FIG. 2, which is an SEM photomicrograph of the panel illustrated in FIG. 1 after being treated with the second medium, the micro-cracks were substantially eliminated.

Example 5

This Example demonstrates a first medium comprising an electrolytic process wherein the metallic surface is dried prior to contacting an electroless second medium. The following Table lists the composition and processing conditions for the first medium, second medium and post treatment drying.

TABLE

| | |
|---|---|
| Metallic Surface | Zinc Plated Rivets Measuring .75 inch × 1.0 inch |
| First Medium | Small Rotating Barrel, 10 minutes, 75C, 10% of N-Grade sodium silicate (SiO2:Na2O ratio 3:22) |
| Second Medium | 10 wt. % N-Grade sodium silicate (SiO2:Na2O ratio 3:22) |
| Current Density For First Medium | 0.045 amps/in$^2$, (1.7 amps for 20 rivets, 1.84 in$^2$) |
| Drying Conditions After Second Medium | 120C, convection oven, 10 minutes |

The corrosion resistance of the metallic surfaces treated in accordance with this Example were evaluated by ASTM B-117 (salt spray). Greater than 140 hours of salt spray exposure were achieved prior to evolution of white rust corrosion products.

The invention has been described with reference to certain aspects. These aspects can be employed alone or in combination. Modifications and alterations will occur to others upon a reading and understanding of this specification. It is intended to include all such modifications and alterations insofar as they come within the scope of the appended claims or the equivalents thereof.

The following is claimed:

1. A method for treating an electrically conductive surface comprising:

contacting at least a portion of the surface with a first medium having a basic pH and substantially free of chromates and comprising sodium silicate comprising at least about 13 w/w % Na2O wherein the first medium has a temperature of about 25 to 95° C., and;

contacting at least a portion of the surface with a second medium comprising at least one siliceous material wherein the siliceous material comprises colloidal silica.

2. The method of claim 1 wherein the first medium comprises at least one polar carrier, sodium silicate soluble within said carrier, colloidal silica, and wherein the first medium has a basic pH and is substantially free of chromates.

3. A method for treating a metallic or an electrically conductive surface comprising:

exposing at least a portion of the surface to an electrolytic environment comprising a first medium comprising a combination comprising at least one polar carrier and at least one oligomeric silicate that is soluble within said carrier wherein said medium has a basic pH and said surface comprises a cathode, and;

exposing at least a portion of the surface to a second medium comprising colloidal silica wherein said second medium comprises an electroless environment.

4. The method of claim 1 wherein the sodium silicate has a SiO2 wt./Na2O wt ratio of about 2.

5. The method of claim 1 wherein the surface comprises at least one member selected from the group consisting of copper, nickel, tin, iron, zinc, aluminum, magnesium, stainless steel and steel and alloys thereof.

6. The method of claim 3 further comprising applying at least one coating upon the treated surface.

7. The method of claim 1 wherein at least one of the first and second mediums further comprise at least one dopant selected from the group consisting of zinc, molybdenum and nickel.

8. The method of claim 1 wherein prior to contacting with said second medium the metal surface is dried at a temperature of at least about 120 C.

9. The method of claim 1 further comprising applying at least one coating upon the treated surface.

10. The method of claim 2 wherein the first medium comprises greater than 1 wt. % of said at least one silicate and further comprises at least one dopant selected from the group consisting of nickel, molybdenum and zinc.

11. The method of claim 1 wherein said surface comprises zinc.

12. The method of claim 3 wherein at least one of said first and second mediums further comprise at least one water soluble compound selected from the group consisting of from the group of titanium chloride, tin chloride, zirconium acetate, zirconium oxychloride, calcium fluoride, tin fluoride, titanium fluoride, zirconium fluoride; ammonium fluorosilicate, aluminum nitrate; magnesium sulphate, sodium sulphate, zinc sulphate, copper sulphate; lithium acetate, lithium bicarbonate, lithium citrate, lithium metaborate, lithium vanadate and lithium tungstate.

13. The method of claim 1 wherein said first medium comprises an electrolytic environment wherein the surface comprises the cathode.

14. The method of claim 1 further comprising rinsing the metal surface, prior to contacting with said second medium, with a solution comprising water and at least one dopant.

15. The method of claim 14 wherein the dopant comprises at least one member selected from the group consisting of molybdenum, titanium, zircon, vanadium, phosphorus, aluminum, iron, boron, bismuth, gallium, tellurium, germanium, antimony, niobium, magnesium, manganese, zinc, aluminum, nickel and their oxides and salts.

16. The method of claim 3 further comprising, prior to said exposing to the first medium, contacting said surface with at least one member selected from the group consisting of acid and basic cleaners.

17. The method of claim 1 wherein said surface comprises a cathode in the electrolytic environment of the first medium and said second medium comprises an electroless environment.

18. The method of claim 9 wherein said coating comprises at least one member chosen from the group of latex, silanes, epoxies, silicone, amines, alkyds, urethanes, polyester and acrylics.

19. A method for treating a chromated or phosphated surface comprising:

exposing at least a portion of the surface to a first medium comprising water, about 1 to about 15 wt % of at least one oligomeric silicate and combinations thereof, wherein said medium has a basic pH and wherein the first medium has a temperature of about 25 to about 95° C., drying the substrate, and;

exposing at least a portion of the surface to a second medium comprising colloidal silica.

20. The method of claim 19 wherein the surface comprises a chromated surface.

21. The method of claim 19 wherein the surface comprises a phosphated surface.

22. The method of claim 1 wherein the first medium comprises about 10 wt. % sodium silicate and the temperature of the first medium is about 75° C.

23. The method of claim 19 wherein said exposing to the first medium comprising an electrolytic process.

24. The method of claim 19 wherein said exposing to the first medium comprises an electroless process.

25. The method of claim 19 wherein prior to the first exposing step the surface is cleaned.

26. The method of claim 19 wherein subsequent to second exposing step the surface is treated with an acidic medium.

27. The method of claim 19 wherein zinc or zinc alloys underlie the chromated or phosphated surface.

28. A method for treating an electrically conductive surface comprising:

contacting at least a portion of the surface with a first medium having a basic pH and substantially free of chromates and comprising sodium silicate comprising at least about 13 w/w % Na2O wherein the first medium has a temperature of about 25 to 95° C. and the first medium comprises an electrolytic environment wherein the surface comprises the cathode, and;

contacting at least a portion of the surface with a second medium comprising at least one siliceous material.

29. A method for treating an electrically conductive surface comprising:

contacting at least a portion of the surface with a first medium having a basic pH and substantially free of chromates and comprising sodium silicate comprising at least about 13 w/w % Na2O wherein the first medium has a temperature of about 25 to 95° C., rinsing with a solution comprising water and at least one dopant, and;

contacting at least a portion of the surface with a second medium comprising at least one siliceous material.

30. The method of claim 28 further comprising applying at least one coating upon the treated surface.

31. The method of claim 29 further comprising applying at least one coating upon the treated surface.

* * * * *